US008347882B2

(12) United States Patent
Chen

(10) Patent No.: US 8,347,882 B2
(45) Date of Patent: Jan. 8, 2013

(54) DIVING SNORKEL-MOUNTED WATER STOPPER WITH MULTIPLE SEPARATED AIR VALVE OPENINGS INDEPENDENTLY CONTROLLABLE BY FLOAT UNITS ARRANGED IN ONE-TO-ONE CORRESPONDENCE THERETO

(76) Inventor: Chien-Rung Chen, Taipei (TW)

( * ) Notice: Subject to any disclaimer, the term of this patent is extended or adjusted under 35 U.S.C. 154(b) by 428 days.

(21) Appl. No.: 12/646,710

(22) Filed: Dec. 23, 2009

(65) Prior Publication Data

US 2011/0146675 A1 Jun. 23, 2011

(51) Int. Cl.
*B63C 11/16* (2006.01)

(52) U.S. Cl. ..... 128/201.11

(58) Field of Classification Search ..... 128/200.24, 128/200.29, 201.11, 201.22–201.23, 201.26–201.27, 128/206.29
See application file for complete search history.

(56) References Cited

U.S. PATENT DOCUMENTS 6,679,253 B1 * 1/2004 Feng ..... 128/201.11

* cited by examiner

*Primary Examiner* — Theodore Stigell
(74) *Attorney, Agent, or Firm* — Muncy, Geissler, Olds & Lowe, PLLC

(57) ABSTRACT

A diving snorkel-mounted water stopper includes a sleeve unit defining a plurality of circumferentially spaced receiving chambers and a plurality of separated air valve openings corresponding to the tops of the receiving chambers; a ring-shaped housing externally located around the sleeve unit and having a plurality of air intakes formed at positions separately corresponding to the receiving chambers and the air valve openings; a plurality of float units separately disposed in the receiving chambers to normally locate below the air valve openings, and a cap closed onto a top of the ring-shaped housing. The separated air valve openings are independently controllable to open or close by the float units arranged in one-to-one correspondence thereto. When one of the air valve openings is closed, other air valve openings are not affected and air from above water surface can still be supplied via the remaining open air valve openings to a diver.

5 Claims, 8 Drawing Sheets

DIVING SNORKEL-MOUNTED WATER STOPPER WITH MULTIPLE SEPARATED AIR VALVE OPENINGS INDEPENDENTLY CONTROLLABLE BY FLOAT UNITS ARRANGED IN ONE-TO-ONE CORRESPONDENCE THERETO

FIELD OF THE INVENTION

The present invention relates to a water stopper, and more particularly to a diving snorkel-mounted water stopper with multiple separated air valve openings independently controllable by float units arranged in one-to-one correspondence thereto.

BACKGROUND OF THE INVENTION

A snorkel is one major device being used by a skin diver in snorkel diving, so that the diver can keep breathing while enjoying underwater scenery.

Please refer to FIG. 1. Generally, a diving snorkel includes a snorkel tube 500 having an upper open end and a lower end having a mouthpiece 510 connected thereto. Air from above water surface can be supplied via the snorkel tube 500 to the diver's mouth for breathing. Air exhaled by the diver can also be exhausted via the snorkel tube 500.

There are chances sea water would invade into the snorkel tube 500 via the upper open end thereof when the diving depth is larger than the length of the snorkel tube 500 or when sea water splashes on the snorkel tube 500, causing the diver to inhale water while taking breath. To avoid such condition, a water stopper is usually mounted to the upper open end of the snorkel tube 500 to automatically close the upper open end when the latter is lower than the water surface, preventing sea water from undesirably entering the snorkel tube 500.

FIG. 1 is a schematic view of a diving snorkel with a conventional water stopper 600 mounted thereto being shown in a sectional view; FIG. 2 is an enlarged sectional view of the conventional water stopper 600 shown in FIG. 1; and FIG. 3 is a cross sectional view taken along line A-A of FIG. 2. As shown, the conventional water stopper 600 includes a sleeve 610 connected to an upper end of a snorkel tube 500 and having a plurality of air valve openings 611 spaced on a diametrically expanded upper end thereof, a ring-shaped housing 620 connected to the upper end of the snorkel tube 500 to locate around the sleeve 610 and having a plurality of air intakes 621 formed thereon, an annular float 630 disposed between the sleeve 610 and the ring-shaped housing 620 to normally locate below the air valve openings 611, and a cap 640 closed onto a top of the ring-shaped housing 620.

When the snorkel tube 500 is used under normal condition, the water stopper 600 is located above the water surface 700 and the annular float 630, due to its own weight, is located at a descended position between the sleeve 610 and the ring-shaped housing 620 to thereby open the air valve openings 611. At this point, air from above water surface can sequentially flow through the air intakes 621, the air valve openings 611, the sleeve 610, and the snorkel tube 500 to the diver's mouth for breathing.

However, when the water surface 700 is higher than the upper end of the snorkel tube 500, sea water will first contact with a bottom of the annular float 630. At this point, the annular float 630 ascends between the sleeve 610 and the ring-shaped housing 620 due to a buoyancy of water to finally close the air valve openings 611. With the closed air valve openings 611, sea water is prevented from invading into the snorkel tube 500 via the air valve openings 611 and the diver is protected from inhaling water.

Meanwhile, the closed air valve openings 611 also prevent the diver from breathing air from above the water surface. The diver is therefore informed that the water surface has already contacted with the bottom of the annular float 630 and the snorkel tube 500 must be adjusted to a different angle to expose from the water surface or the diving depth must be reduced, so that the annular float 630 is located above the water surface and can therefore descend between the sleeve 610 and the ring-shaped housing 620 to open the air valve openings 611 again, allowing the diver to breathe air from above the water surface.

Please refer to FIG. 2. As a matter of fact, the snorkel tube 500 is usually not always in a fully vertical state but will tilt in different directions along with the diver's head when the diver moves about underwater to see surrounding scenery.

According to the conventional water stopper 600, the annular float 630 serving to control the open and close of the air valve openings 611 is an integrally formed one-piece float unit. Whenever the snorkel tube 500 in use is tilted to cause any side of the bottom of the annular float 630 to contact with the water surface 700, the whole annular float 630 would immediately ascend due to the buoyancy of water to thereby close all the air valve openings 611, as shown in FIGS. 2 and 3. As a result, the diver must immediately adjust the inclination angle of the snorkel tube 500 or reduce the diving depth, lest the annular float 630 should keep closing the air valve openings 611.

As having been mentioned above, the snorkel tube 500 in use is usually frequently in a tilted position. Therefore, when one side of the bottom of the annular float 630 contacts with the water surface 700, an opposing side of the bottom of the annular float 630 might still be higher than the water surface 700. The diver would not have to immediately adjust the inclination angle of the snorkel tube 500 or reduce the diving depth if the air valve openings 630 closer to the opposing side of the annular float 630 above the water surface 700 are kept open to let in external air to the snorkel tube 500 for breathing. However, with the integrally formed one-piece annular float 630 for the conventional water stopper 600, all the air valve openings 611 are closed simultaneously when any part of the bottom of the annular float 630 is in contact with the water surface 700 because the one-piece annular float 630 always ascends as a whole between the sleeve 610 and the ring-shaped housing 620. Therefore, with the conventional water stopper 600, the diver has to frequently adjust the inclination angle of the snorkel tube 500 or reduce the diving depth in response to the water-contacting annular float 630. This is of course inconvenient for the diver to do so.

Furthermore, according to the conventional water stopper 600, the cap 640 is closed onto the top of the ring-shaped housing 620 without shielding the air intakes 621 on the ring-shaped housing 620 from splashing waves. Therefore, splashing waves tend to invade into the snorkel tube 500 via the unshielded air intakes 621, causing the diver to unexpectedly inhale water while taking breath.

SUMMARY OF THE INVENTION

A primary object of the present invention is to provide a diving snorkel-mounted water stopper with multiple separated air valve openings independently controllable by float units arranged in one-to-one correspondence thereto.

Another object of the present invention is to provide a diving snorkel-mounted water stopper with multiple separated air valve openings independently controllable by float units arranged in one-to-one correspondence thereto and having a cap with an annular wall shielding a plurality of air intakes from splashing waves.

A further object of the present invention is to provide a diving snorkel-mounted water stopper with multiple separated air valve openings independently controllable by float units arranged in one-to-one correspondence thereto, which has excellent applicability.

To achieve the above and other objects, the diving snorkel-mounted water stopper according to an embodiment of the present invention includes a sleeve unit being connected to an upper end of a snorkel tube of a diving snorkel, and including a hollow sleeve body and a diameter-increased ring member connected to an upper end of the hollow sleeve body, the hollow sleeve body being formed on an outer surface with a plurality of spaced and axially extended receiving chambers, the ring member defining a plurality of air valve openings therein to communicate with the receiving chambers in one-to-one correspondence; a ring-shaped housing being externally located around the sleeve unit and above the upper end of the snorkel tube, a plurality of air intakes being formed and circumferentially spaced on a wall of the ring-shaped housing to extend through the wall in a thickness direction thereof, and the air intakes being arranged at positions corresponding to and in the same number as that of the air valve openings; a plurality of float units being independently disposed in the receiving chambers to normally locate below the air valve openings; and a cap being closed onto a top of the ring-shaped housing. The plurality of air valve openings provided on the water stopper can be independently controlled to open or close by the plurality of float units that are arranged on the water stopper in one-to-one correspondence to the air valve openings. Therefore, even if one of the air valve openings is closed by the corresponding float unit ascended in the corresponding receiving chamber, air from above the water surface can still be supplied to the diver for breathing via other still opened air valve openings.

According to an operable embodiment of the present invention, the hollow sleeve body is provided on the outer surface with a plurality of axially extended, circumferentially spaced, and radially projected partitioning plates, and the ring member being connected to upper outer corners of the partitioning plates, such that each of the receiving chambers and the corresponding air valve opening thereof are defined between the outer surface of the hollow sleeve body, the ring member, and any two adjacent ones of the partitioning plates.

According to another operable embodiment of the present invention, the hollow sleeve body is provided on the outer surface in each of the receiving chambers with an axially extended engaging rib, and each of the float units is provided on one face facing toward the outer surface of the hollow sleeve body with an engaging channel configured corresponding to the engaging ribs. Therefore, the engaging ribs are slidably engaged with respective corresponding engaging channels, and the float units can be stably attached to the sleeve unit through engagement of the engaging channels with the engaging ribs and stably ascend and descend in the corresponding receiving chambers under guidance by the engaging ribs.

According to an embodiment of the present invention, the cap includes an annular wall formed along a rim thereof, and the annular wall is located outside the air intakes to shield the same from splashing waves when the cap is closed onto the top of the ring-shaped housing.

In the present invention, each of the float units is a curve-sectioned column-shaped float unit to match the configuration of the outer surface of the hollow sleeve body and of an inner surface of the ring-shaped housing.

According to another embodiment of the present invention, the hollow sleeve body of the sleeve unit includes a sleeve main body and a corresponding joining body. The sleeve main body is provided on an outer surface with a plurality of axially extended and circumferentially spaced grooves. The ring member is connected to a top of the joining body, and the axially extended and circumferentially spaced partitioning plates are connected at upper ends to the ring member. When the joining body is assembled to the sleeve main body to form the hollow sleeve body, radially inner edges of the partitioning plates are correspondingly received in the grooves to define the receiving chambers between the outer surface of the sleeve main body, the ring member and adjacent partitioning plates, and the air valve openings are correspondingly defined above the receiving chambers.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
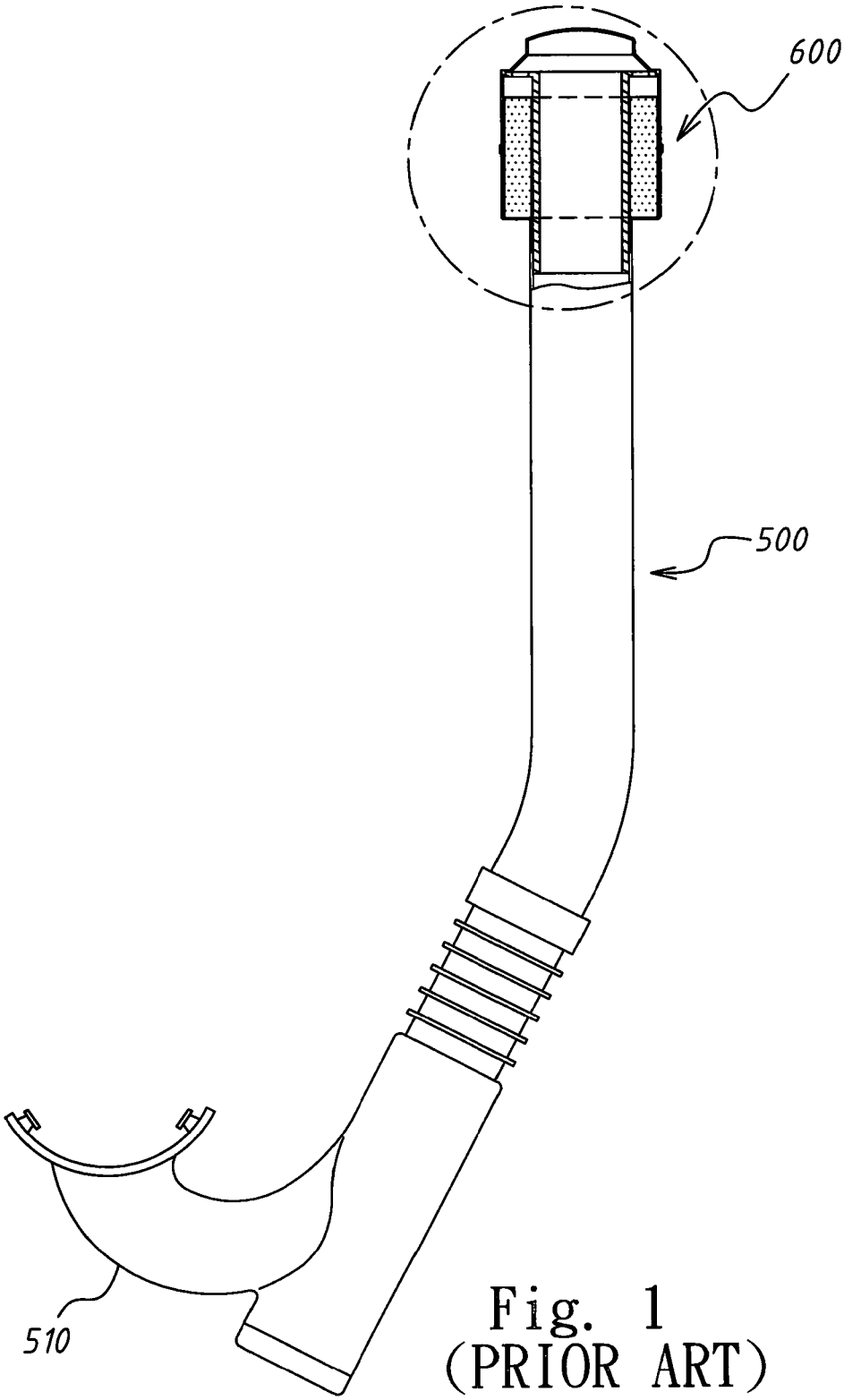
Fig. 1 (PRIOR ART)
FIG. 1 is a schematic view of a diving snorkel with a conventional water stopper mounted thereto being shown in a sectional view.
Figure 3:
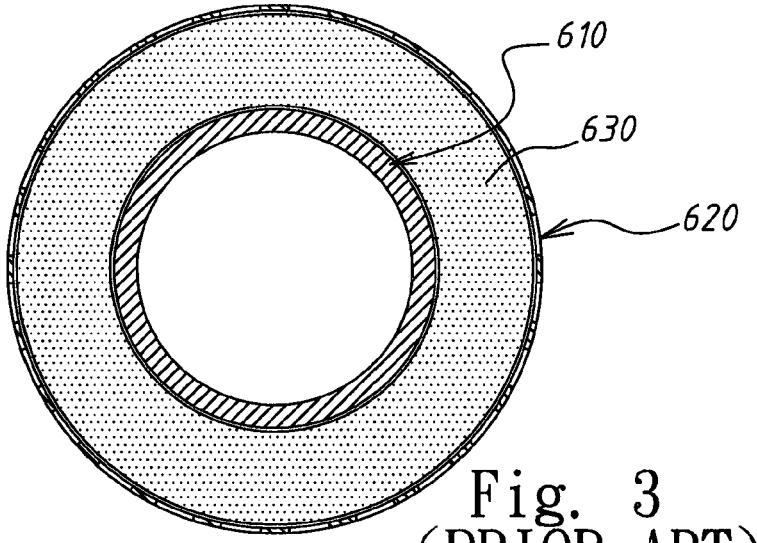
Fig. 3 (PRIOR ART)
FIG. 3 is a cross sectional view taken along line A-A of FIG. 2.
Figure 2:
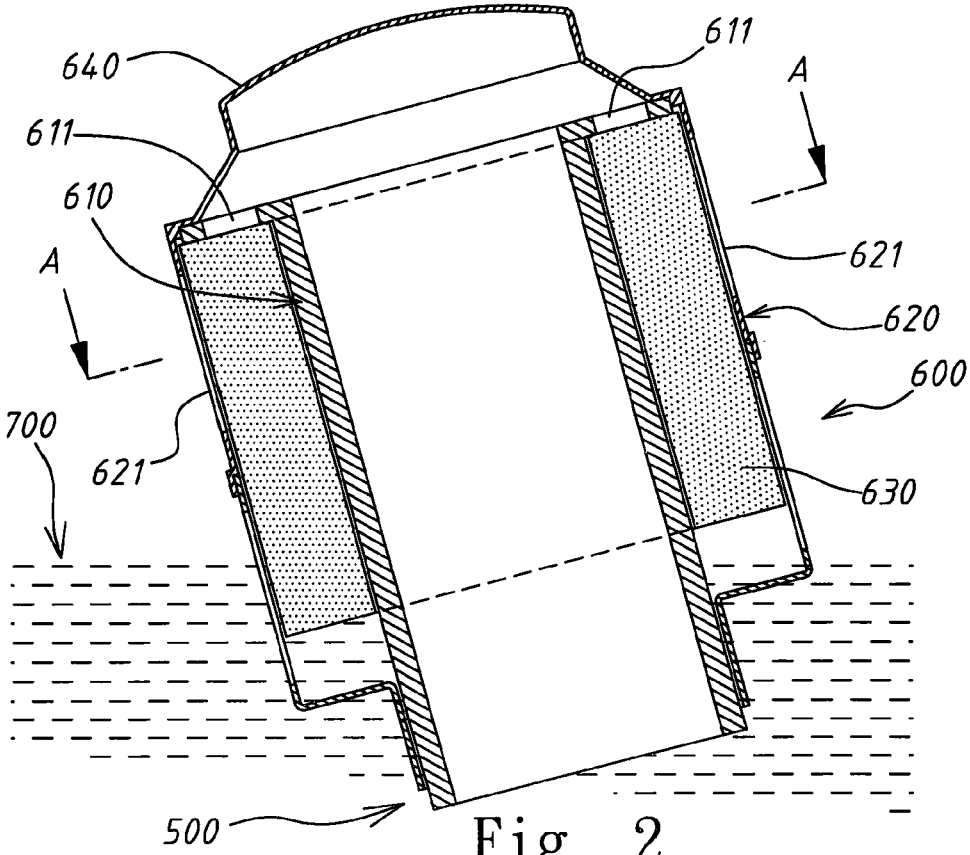
Fig. 2 (PRIOR ART)
FIG. 2 is an enlarged sectional view of the conventional water stopper shown in FIG. 1.
Figure 4:
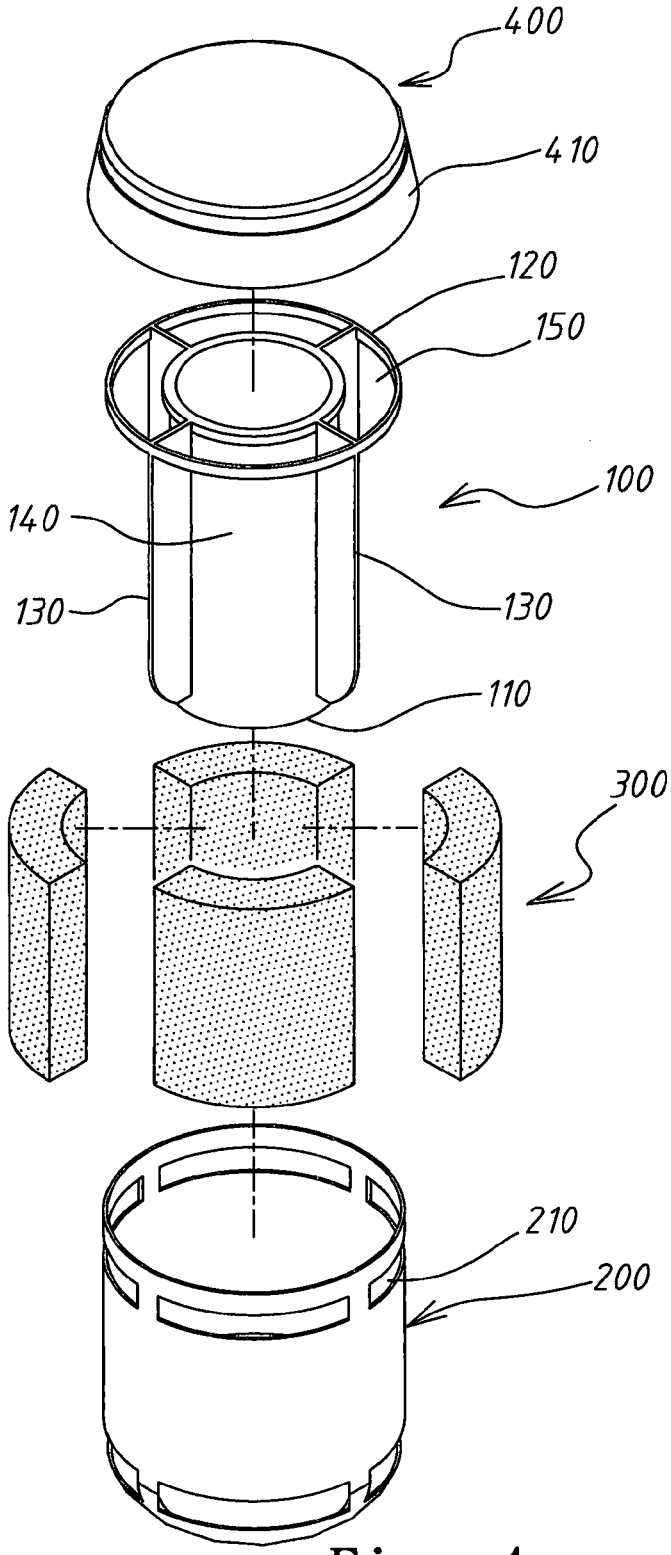
FIG. 4 is an exploded perspective view of a diving snorkel-mounted water stopper with multiple separated air valve openings independently controllable by float units arranged in one-to-one correspondence thereto according to a first embodiment of the present invention.
Figure 5:
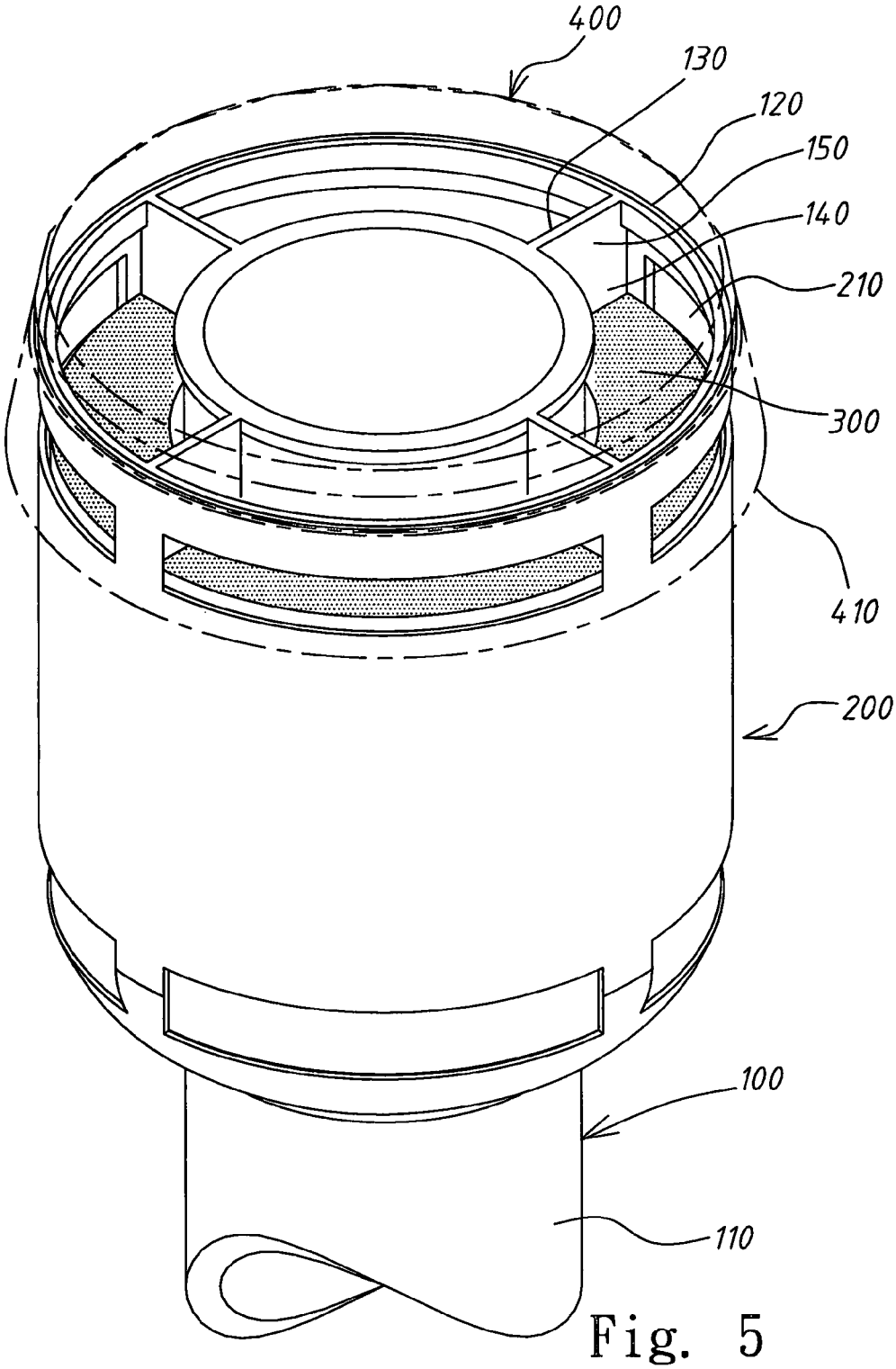
FIG. 5 is an assembled perspective view of the diving snorkel-mounted water stopper of FIG. 4.

The present invention will now be described with some preferred embodiments thereof. For the purpose of easy to understand, elements that are the same in the preferred embodiments are denoted by the same reference numerals.

Please refer to FIGS. 4 through 8, in which a diving snorkel-mounted water stopper with multiple separated air valve openings independently controllable by float units arranged in one-to-one correspondence thereto according to a first embodiment of the present invention is shown. As shown, the diving snorkel-mounted water stopper is mounted to an upper end of a snorkel tube 500 of a diving snorkel, and includes a sleeve unit 100, a ring-shaped housing 200, a plurality of float units 300, and a cap 400.

The sleeve unit 100 is connected to the upper end of the snorkel tube 500 and includes a hollow sleeve body 110. On an outer surface of the hollow sleeve body 110, there is provided a plurality of axially extended, radially projected, and circumferentially spaced partitioning plates 130 (four are shown in the illustrated first embodiment) to define a plurality of separated receiving chambers 140 on an outer side of the hollow sleeve body 110. A ring member 120 is connected to upper outer corners of the partitioning plates 130 to thereby define a plurality of separated air valve openings 150 between an upper end of the hollow sleeve body 110, upper ends of the partitioning plates 130, and the ring member 120. The air valve openings 150 and the receiving chambers 140 are communicable with one another in one-to-one correspondence.

The ring-shaped housing 200 is externally located around the sleeve unit 100 and above the upper end of the snorkel tube 500. A plurality of air intakes 210 is formed and circumferentially spaced on a wall of the ring-shaped housing 200 to extend through the wall in a thickness direction thereof. The air intakes 210 are located at positions corresponding to and in the same number as that of the receiving chambers 140 and the air valve openings 150.

The float units 300 (four are shown in the illustrated first embodiment) are separately received in the receiving chambers 140 and located below the air valve openings 150. The float units 300 are axially movable upward and downward in the receiving chambers 140 along the hollow sleeve body 110 independent of one another. When the float units 300 descend in the receiving chambers 140, they are moved away from the air valve openings 150 to open the latter; and when the float units 300 ascend in the receiving chambers 140, they will bear respective upper end surfaces against the air valve openings 150 to thereby close the latter. The float units 300 are configured to match the configuration of the outer surface of the hollow sleeve body 100 and of an inner surface of the ring-shaped housing 200, and are therefore in the shape of a curve-sectioned column each.

The cap 400 is fitted around a top of the ring-shaped housing 200 to cover an upper open end thereof and accordingly, the upper end of the snorkel tube 500.

Figure 7:
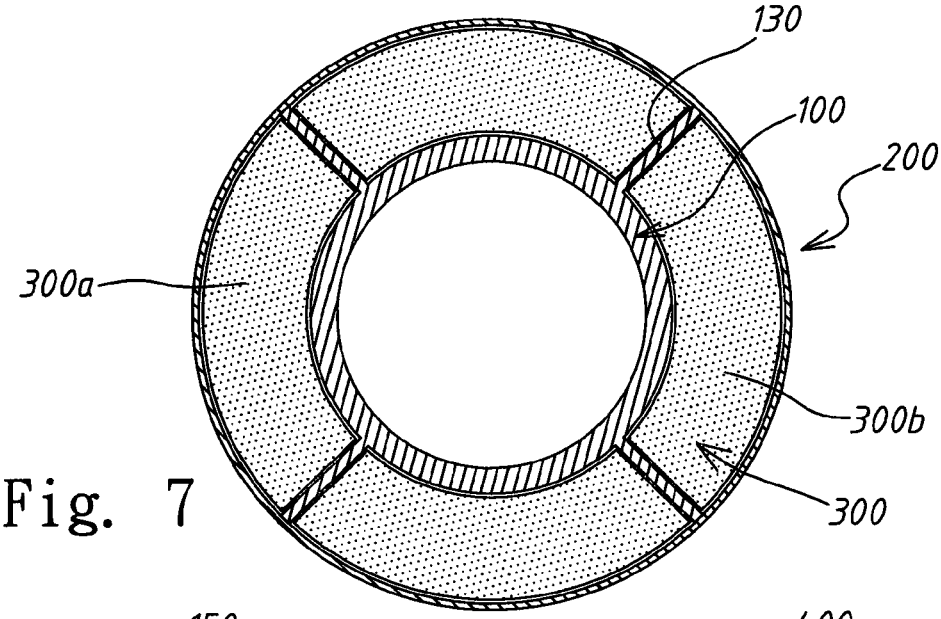
FIG. 7 is a cross sectional view taken along line B-B of FIG. 6.
Figure 6:
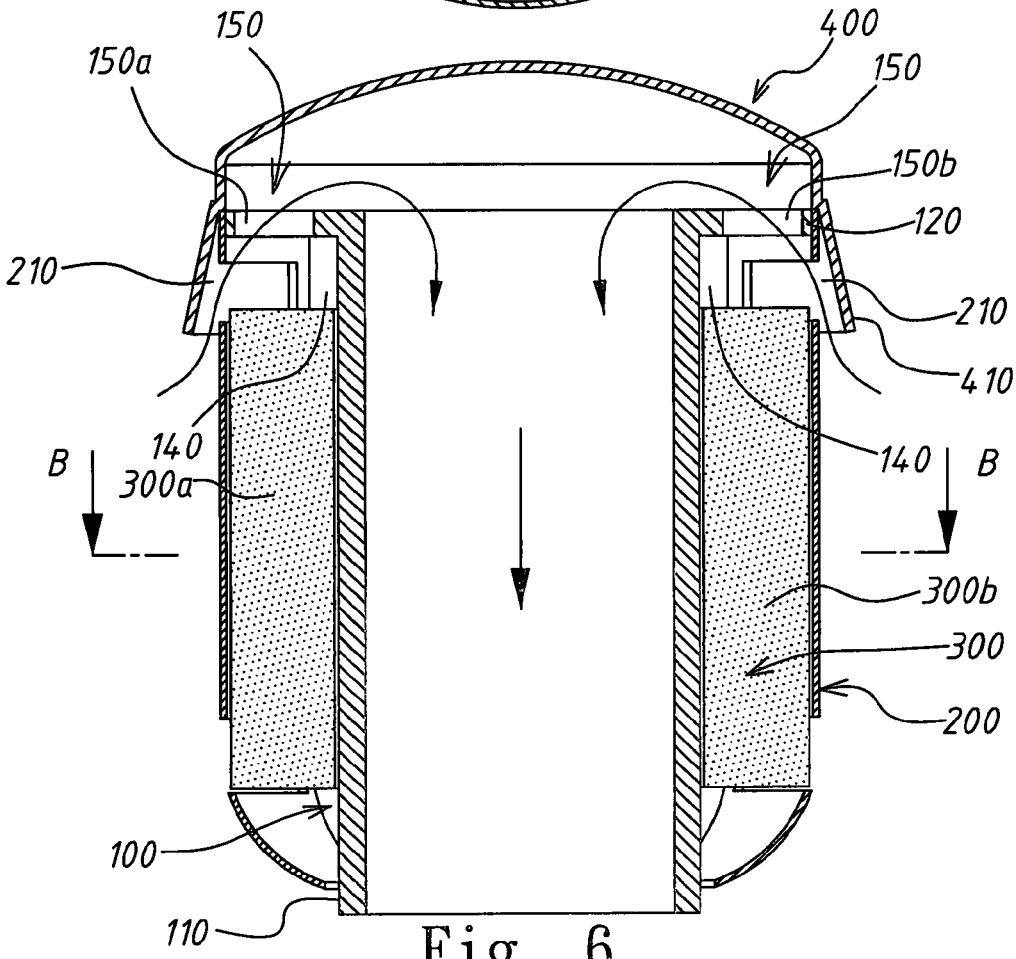
FIG. 6 is a sectioned side view of FIG. 5.

Please refer to FIGS. 6 and 7. When the diving snorkel is used in a normal state, that is, a water surface is lower than the bottoms of all the float units 300, the float units 300, due to their own weight, are located at a descended position in the receiving chambers 140 to thereby open the air valve openings 150. At this point, ambient air can flow through the air intakes 210 on the ring-shaped housing 200, the air valve openings 150 on the sleeve unit 100, an internal space of the hollow sleeve body 110 of the sleeve unit 100, and an internal space of the snorkel tube 500 to a diver's mouth (not shown), so that the diver can breath air from above the water surface.

Figure 8:
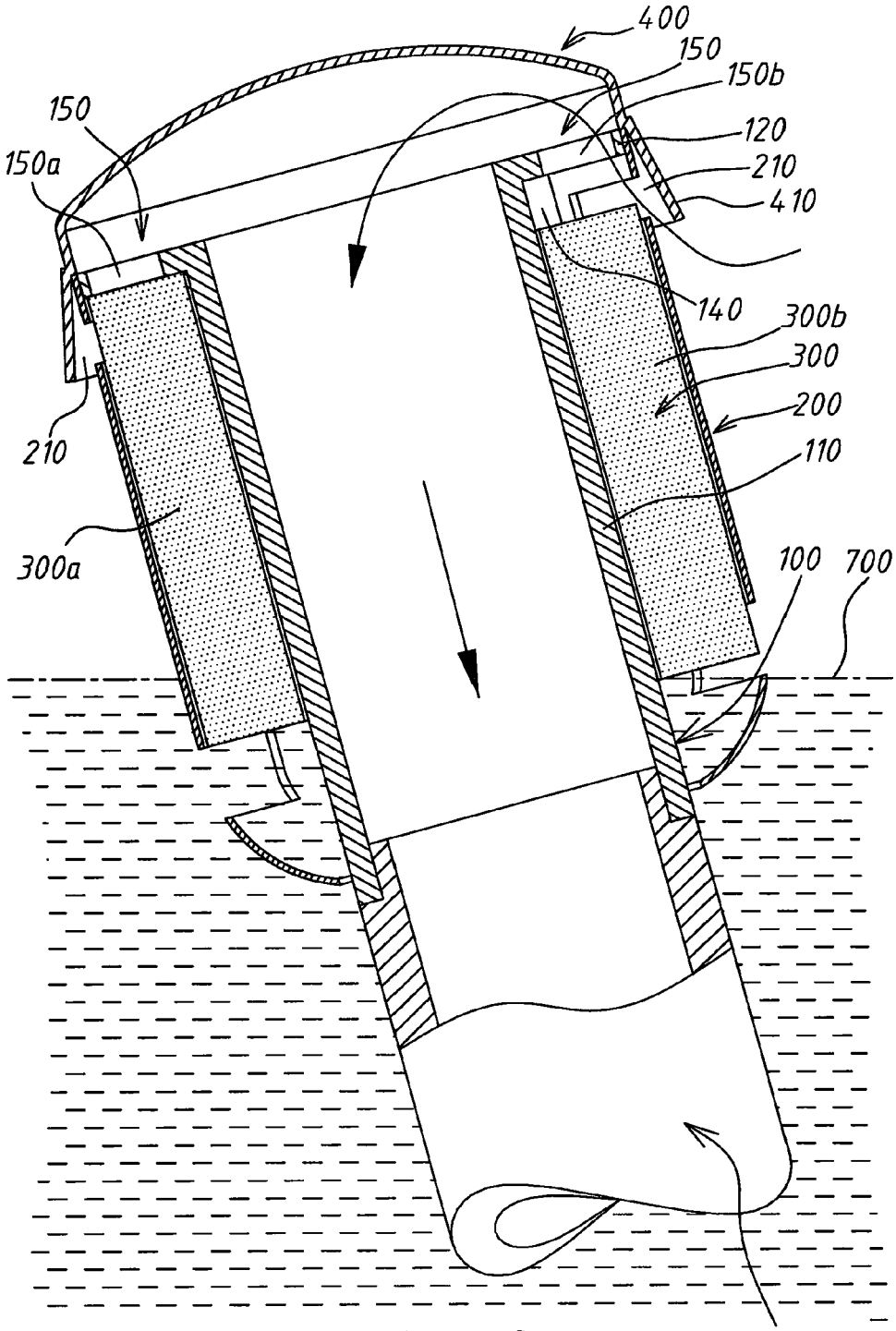
FIG. 8 shows the manner in which the diving snorkel-mounted water stopper of the present invention operates.

Please refer to FIG. 8. When the diving snorkel is in a tilted state with one of the float units 300, such as a first float unit 300*a*, having a bottom in contact with the water surface 700, the first float unit 300*a* is brought to float independently in the corresponding receiving chamber 140 to close the corresponding air valve opening 150, such as a first air valve opening 150*a*. However, another float unit 300, such as a second float unit 300*b* that is located diametrically opposite to the first float unit 300*a*, might have a bottom that is still located above the water surface 700 at that time, leaving the float unit 300*b* in a descended position in the corresponding receiving chamber 140 and the corresponding air valve opening, such as a second air valve opening 150*b*, in an opened state, so that ambient air can still flow through the air intake 210 and the second air valve opening 150*b* and be supplied to the diver for breathing. That is, it is not necessary for the diver to immediately adjust an inclination angle of the tilted snorkel tube 500 or to reduce a diving depth. Thus, with the diving snorkel-mounted water stopper of the present invention, the diver need not adjust his or her snorkel tube or reduce the diving depth frequently.

On the other hand, when all the float units 300 are contacted at their bottom with the water surface 700 to thereby ascend in the receiving chambers 140 and finally close all the air valve openings 150, sea water is stopped from invading into the snorkel tube 500 via the air valve openings 150, preventing the diver from inhaling water while taking breathe or becoming choked.

When the float units 300 respectively close the corresponding air valve openings 150 and the diver could not breathe air from above the water surface 700, the diver is reminded that the water surface 700 is now in contact with the bottom of all the float units 300 and it is necessary to adjust the inclination angle of the snorkel tube 500 or reduce the diving depth for any of the float units 300 to locate higher than the water surface 700 and descend in the corresponding receiving chamber 140 to open the corresponding air valve opening 150 again, allowing the diver to breathe air from above the water surface 700.

The cap 400 includes an annular wall 410 formed along a rim thereof. When the cap 400 is closed onto the top of the ring-shaped housing 200, the annular wall 410 is located outside the air intakes 210 to shield the same from instantaneous splashing waves, lest water should invading into the snorkel tube 500 via the air intakes 210 to choke the diver.

Figure 9:
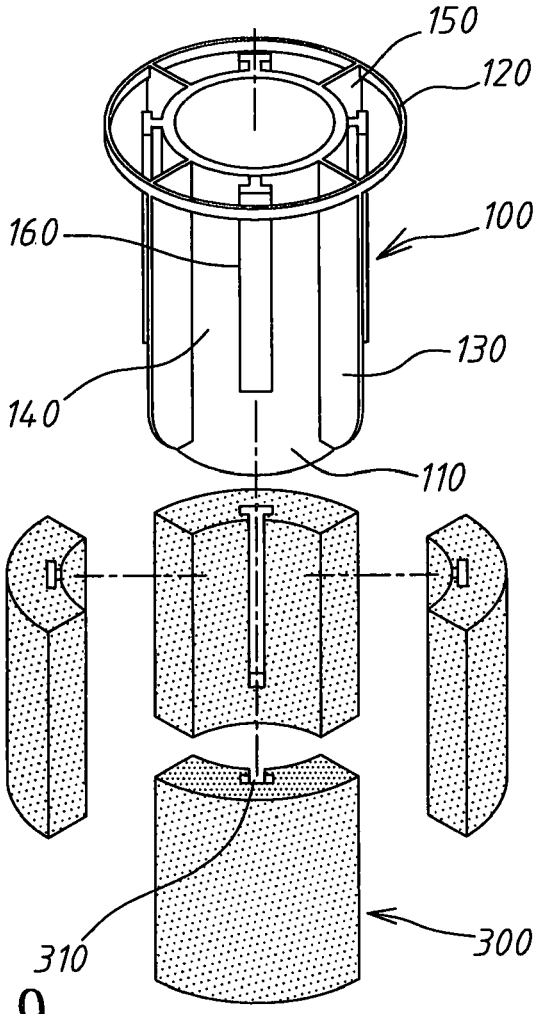
FIG. 9 is an exploded perspective view of a diving snorkel-mounted water stopper with multiple separated air valve openings independently controllable by float units arranged in one-to-one correspondence thereto according to a second embodiment of the present invention.
Figure 10:
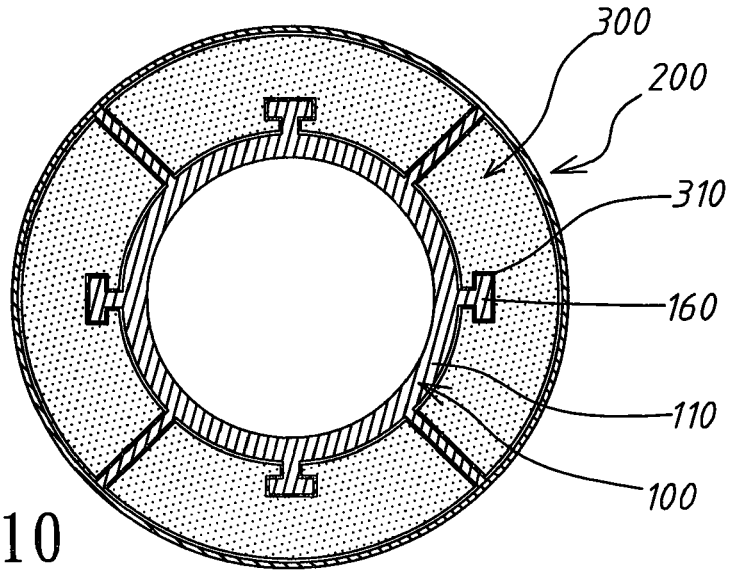
FIG. 10 is an assembled cross sectional view of the diving snorkel-mounted water stopper according to the second embodiment of the present invention.

Please refer to FIGS. 9 and 10 that are exploded perspective and assembled cross sectional views, respectively, of a diving snorkel-mounted water stopper with multiple separated air valve openings independently controllable by float units arranged in one-to-one correspondence thereto according to a second embodiment of the present invention. The second embodiment is generally structurally similar to the first embodiment, except that an axially extended engaging rib 160, such as a T-sectioned engaging rib, is provided on the outer surface of the hollow sleeve body 110 of the sleeve unit 100 in each of the receiving chambers 140, and an axially extended engaging channel 310 configured corresponding to the engaging rib 160, such as a T-sectioned channel, is provided on one face of each of the float units 300 facing toward the outer surface of the hollow sleeve body 110. Therefore, the float units 300 can be stably attached to the sleeve unit 100 through engagement of the engaging channels 310 with the engaging ribs 160, and stably ascend and descend in the corresponding receiving chambers 140 under guidance by the engaging ribs 160. In a variation of the second embodiment, since the float units 300 are associated with the sleeve unit 100 to ascend and descend in the corresponding receiving chambers 140, the partitioning plates 130 can be omitted from the sleeve unit 100.

Figure 11:
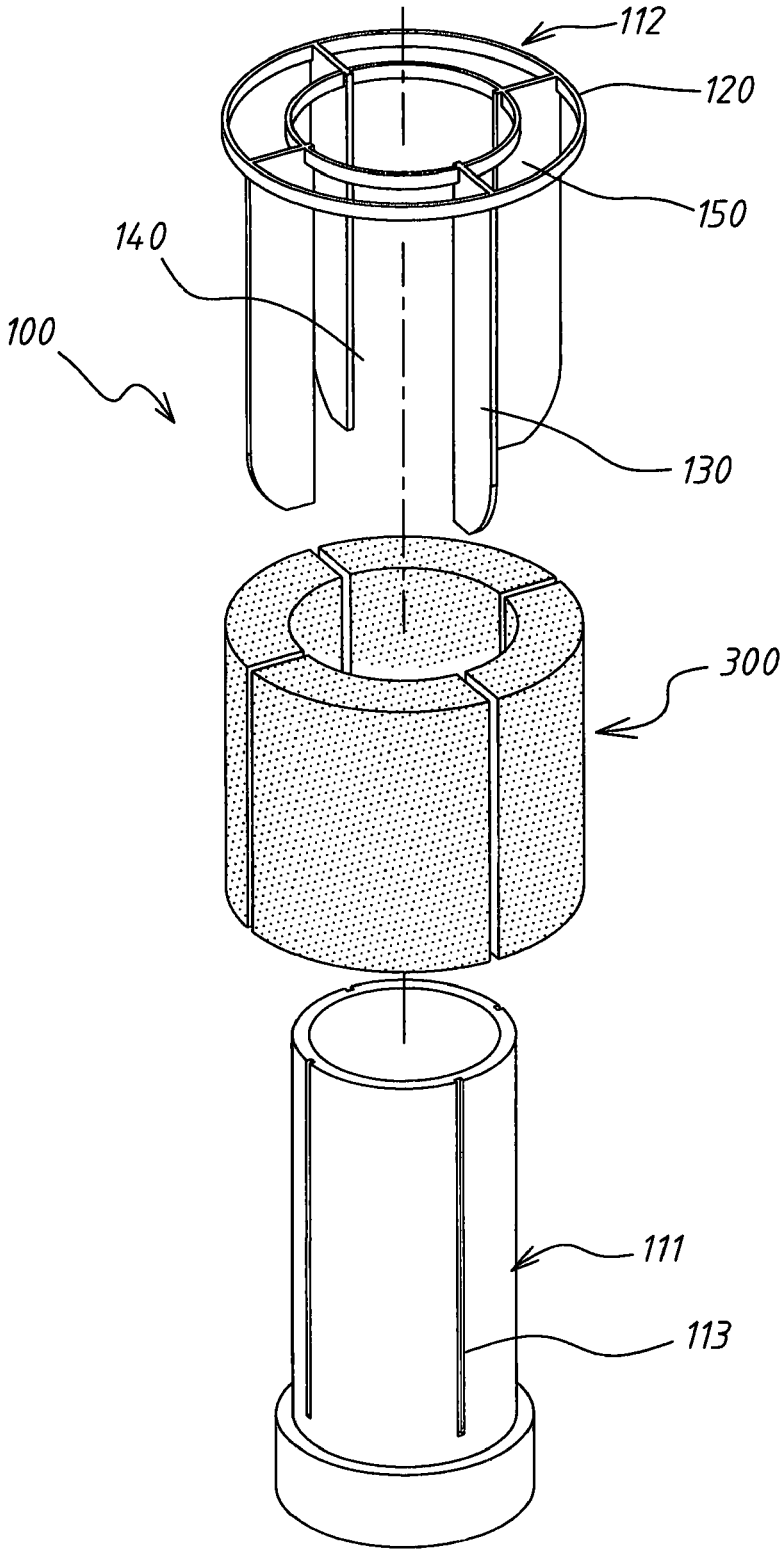
FIG. 11 is an exploded perspective view of a diving snorkel-mounted water stopper with multiple separated air valve openings independently controllable by float units arranged in one-to-one correspondence thereto according to a third embodiment of the present invention.

FIG. 11 is an exploded perspective view of a diving snorkel-mounted water stopper with multiple separated air valve openings independently controllable by float units arranged in one-to-one correspondence thereto according to a third embodiment of the present invention. The third embodiment is different from the first embodiment mainly in a two-piece sleeve unit 100, which has a hollow sleeve body 110 assembled from a sleeve main body 111 and a corresponding joining body 112. The sleeve main body 111 is provided on an outer surface with, for example, four axially extended and circumferentially spaced grooves 113. The joining body 112 includes a ring member 120 and, for example, four axially extended and circumferentially spaced partitioning plates 130 connected at upper ends to the ring member 120. When the joining body 112 is assembled to the sleeve main body 111, radially inner edges of the partitioning plates 130 are correspondingly received in the grooves 113, such that a receiving chamber 140 is formed between the outer surface of the sleeve main body 111, the ring member 120, and any two adjacent partitioning plates 130, and an air valve opening 150 is formed above each of the receiving chambers 140. In the illustrated third embodiment, there are four receiving chambers 140 and four air valve openings 150. And, there are four float units 300 independently upward and downward movably received in the receiving chambers 140 to control the close or open of respective corresponding air valve openings 150.

With the diving snorkel-mounted water stopper of the present invention, a plurality of air valve openings provided on the water stopper can be independently controlled to open or close by a plurality of float units that are arranged on the water stopper in one-to-one correspondence to the air valve openings. Therefore, even if one of the air valve openings is closed by the corresponding float unit ascended in the corresponding receiving chambers, air from above the water surface can still be supplied to the diver for breathing via other still opened air valve openings. Further, the annular wall of the cap located around and shielding the air intakes can effectively guard the snorkel tube against invasion by splashing waves. With the above arrangements, the objects of the present invention can be exactly achieved.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A diving snorkel-mounted water stopper with multiple separated air valve openings independently controllable by float units arranged in one-to-one correspondence thereto, the water stopper being mounted to an upper end of a snorkel tube of a diving snorkel to prevent sea water from unexpectedly invading into an inner space of the snorkel tube, and comprising:

a sleeve unit being connected to the upper end of the snorkel tube, and including a hollow sleeve body and a diameter-increased ring member connected to an upper end of the hollow sleeve body; the hollow sleeve body being formed on an outer surface with a plurality of spaced and axially extended receiving chambers, the ring member defining a plurality of separated air valve openings to communicate with the receiving chambers in one-to-one correspondence;

a ring-shaped housing being externally located around the sleeve unit and the upper end of the snorkel tube; a plurality of air intakes being formed and circumferentially spaced on a wall of the ring-shaped housing to extend through the wall in a thickness direction thereof; and the air intakes being arranged at positions corresponding to and in the same number as that of the air valve openings;

a plurality of float units being independently disposed in the receiving chambers to normally locate below the air valve openings; and a cap being closed onto a top of the ring-shaped housing, wherein the hollow sleeve body is provided on the outer surface in each of the receiving chambers with an axially extended engaging rib, and each of the float units is provided on one face facing toward the outer surface of the hollow sleeve body with an engaging channel configured corresponding to the engaging ribs, whereby the engaging ribs are slidably engaged with corresponding engaging channels, wherein the cap includes an annular wall formed along a rim thereof; the annular wall being located outside the air intakes to shield the same from splashing waves when the cap is closed onto the top of the ring-shaped housing.

2. The diving snorkel-mounted water stopper as claimed in claim 1, wherein the hollow sleeve body is provided on the outer surface with a plurality of axially extended, circumferentially spaced, and radially projected partitioning plates, and the ring member being connected to upper outer corners of the partitioning plates, such that each of the receiving chambers and the corresponding air valve opening thereof are defined between the outer surface of the hollow sleeve body, the ring member, and any two adjacent ones of the partitioning plates.

3. The diving snorkel-mounted water stopper as claimed in claim 2, wherein each of the float units is a curve-sectioned column-shaped float unit.

4. The diving snorkel-mounted water stopper as claimed in claim 3, wherein the engaging ribs are T-sectioned engaging ribs and the engaging channels are T-sectioned engaging channels.

5. The diving snorkel-mounted water stopper as claimed in claim 4, wherein each of the float units is a curve-sectioned column-shaped float unit.

* * * * *